US005216810A

United States Patent [19]

Kendall

[11] Patent Number: 5,216,810

[45] Date of Patent: Jun. 8, 1993

[54] ALUMINUM EXTRUSION WITH MULTIPLE THERMAL BRAKE AND METHOD OF MAKING SAME

[75] Inventor: Stephen F. Kendall, Gladwyne, Pa.

[73] Assignee: Aluminum Shapes, Inc., Delair, N.J.

[21] Appl. No.: 899,836

[22] Filed: Jun. 17, 1992

Related U.S. Application Data

[62] Division of Ser. No. 640,085, Jan. 11, 1991.

[51] Int. Cl.[5] ..... B23P 13/00

[52] U.S. Cl. ..... 29/897.312; 52/309.14

[58] Field of Search ..... 52/720, 721, 309.9, 52/309.14, 309.3, 404, 656, 731; 264/46.6, 46.7; 49/DIG. 1; 29/897.312, 418

[56] References Cited

U.S. PATENT DOCUMENTS

| | | | |
|---|---|---|---|
| 3,204,324 | 9/1965 | Nilsen | 52/309.3 |
| 3,605,994 | 9/1971 | Parlette | 52/731 |
| 3,786,609 | 1/1974 | Difazio | 52/309.9 |
| 3,832,818 | 9/1974 | Nohr | 52/731 |
| 4,185,439 | 1/1980 | Bischlipp et al. | 52/731 |
| 4,342,144 | 8/1982 | Doguchi | 52/731 |
| 4,688,366 | 8/1987 | Schmidt | 52/731 |

*Primary Examiner*—Carl D. Friedman

*Assistant Examiner*—Michele A. Van Patten

*Attorney, Agent, or Firm*—Jay M. Cantor

[57] ABSTRACT

A method of making an aluminum extrusion having a pair of thermal brakes therein and the extrusion, comprising the steps of providing an aluminum extrusion having a pair of side walls, upper and lower wall members, each secured to each of the side walls and a chamber forming a portion of each of the wall members spaced from the side walls, one of the chambers having a continuous bridge member forming a wall thereof and forming the only bridge connecting portions of the upper wall member, the other of the chamber having a discontinuous bridge member forming a portion of a wall thereof, and a "V"-shaped member bridging the discontinuity in the discontinuous bridge member, disposing thermal braking material in the chamber having a continuous bridge member and allowing the thermal braking material to set in the chamber, providing a continuous slit in the continuous bridge member and the V-shaped member to cause a thermal separation of the side walls from each other, placing a leak preventing member in the V-shaped member and over the continuous slit therein, filling the V-shaped member with a thermal braking liquid and allowing the thermal braking material to set in the V-shaped member.

8 Claims, 2 Drawing Sheets

ALUMINUM EXTRUSION WITH MULTIPLE THERMAL BRAKE AND METHOD OF MAKING SAME

This application is a division of application Ser. No. 07/640,085, filed Jan. 11, 1991.

BACKGROUND OF THE INVENTION

1. Field of the Invention

This invention relates to aluminum extrusions and methods of makings same and, more specifically, to aluminum extrusions having multiple thermal brakes and a method of making same.

2. Brief Description of the Prior Art

Aluminum extrusions having a single thermal brake are well known in the art. A typical extrusion with a single thermal brake is shown in the patent of Nilsen (U.S. Pat. No. 3,204,324), the disclosure of which is incorporated herein by reference, wherein two portions of the same extrusion are joined by a bridge therebetween which forms a part of the original extrusion. The bridge maintains the desired dimensional relationship between the two extrusion wall portions to very accurate tolerances during further processing. The bridge forms a wall portion of a chamber into which is poured a hardenable or settable thermal braking material which has very low thermal conductivity. After the hardenable material has set within the chamber, the bridge is broken so that the two extrusion portions are coupled together only with the thermal braking material to provide thermal insulative properties between the two extrusion portions. Extrusions of this type have found great acceptance, particularly in conjunction with the construction of windows, where thermal insulation from the exterior to the interior of a building is necessary.

More recently, aluminum extrusions have been developed which include a pair of thermal braking elements therein, each thermal braking element being disposed in one of two bridge or spacer elements supporting opposing walls of the extrusion. The pair of spacer elements with thermal braking elements is required to provide support and insure that dimensional tolerances are maintained between the opposing extrusion walls while also providing the required thermal isolation between the opposing walls after completion of fabrication.

To provide the pair of thermal brakes in a single member, one form of prior art has utilized two separate extrusions with a pair of preformed thermal insulators which are force fitted into grooves therefore in each of the extrusions. The final product with two thermal brakes fabricated by this procedure has difficulty maintaining dimensional tolerances and is relatively expensive to manufacture due to the requirement of two separate extrusions and a custom fabricated thermal insulating element which is manually inserted into grooves in both extrusions.

Another form of prior art extrusion with two thermal brakes therein provides a pair of chambers, one in each bridging element, one of the bridging element having a pair of extensions or receivers spaced from and beneath the chamber for carrying a rigid vinyl member therein. The above described procedure of Nilsen is used to form a first one of the thermal brakes in one of the chambers. The liquid thermal braking material is poured into one of the two chambers and permitted to set therein. Then a portion of the bridge material is removed from the chambers for both of the thermal brakes prior to pouring of the liquid thermal braking material into the second chamber because it is difficult to sever the bridge material of only one of the bridges. It follows that, with both of the bridges severed, the second chamber no longer has the continuous bridge so the liquid braking material cannot be retained in the second chamber if now poured therein. This problem has been alleviated in the prior art by placing a rigid vinyl strip insert over the extensions or receivers and beneath the severed portion of the chamber or break in the bridge material of the second chamber to close the break therein and permit the liquid braking material to be poured into the second chamber and set therein.

A problem with this procedure is that the extrusion are quite long, usually on the order of about 18 feet in length, thereby making the cost of placing the rigid vinyl strip in the channel beneath the severed region of each extrusion economically prohibitive. This is due to the fact that the rigid vinyl strip (stop gap material) must be held to tight manufacturing tolerances in order to fit into the chamber without binding or jamming along the length of the aluminum extrusion or conversely without being too loose to eliminate leakage of thermal braking material into the main chamber of the hollow aluminum extrusion. For the same reasons, the receivers of the vinyl strip in the aluminum extrusion itself must be held to strict, better than standard, tolerances to be able to accept the vinyl strip prior to filling with thermal brake material. Also, this arrangement results in weak extrusion elements which leads to premature breakage. Furthermore, the removal of a portion of the bridging element in one of the thermal brake material holding chambers either during extrusion or prior to incorporation of the thermal braking material into either of the chambers, permits the extrusion walls to rotate about the one bridging element and providing a problem of dimensional tolerancing. It is therefore apparent that a less costly procedure and improved multiple thermal brake extrusion is highly desirable.

SUMMARY OF THE INVENTION

In accordance with the present invention, the above described problems of the prior art are overcome and there is provided a method of making an improved aluminum extrusion and the extrusion itself which can be easily and much more economically fabricated than the prior art extrusions having multiple thermal brakes therein.

Briefly, in accordance with the present invention, an aluminum extrusion is provided from an extrusion press in standard manner having a pair of opposing side walls and a pair of support walls therebetween having chambers or grooves for later receiving thermal braking material in the manner set forth in the patent of Nilsen (U.S. Pat. No. 3,204,324). One of the chambers is shaped generally in accordance with the prior art as shown in the above noted Nilsen patent. However, the second chamber has a break in the bridging wall therein as extruded with a thin inwardly tapered, preferably V-shaped member preferably having a flat bottom portion spanning the break. After the chamber which is shaped in accordance with the prior art is filled with the thermal braking material and the material sets, the bridge of that chamber is severed as in the prior art and a part of the V-shaped member is also severed, generally during the same severing operation. At this time, the severed V-shaped member has a flexible spline, preferably of vinyl, disposed over the severed portion in the flat bottom thereof and secured therein by the remaining portion of the V-shaped member. The thermal braking liquid is then be poured into the second chamber and sets therein, either over the spline or also partially in the V-shaped member if the spline does not occupy the entire volume thereof without dripping out of the second chamber. As noted above, the spline is flexible and can be formed of any material which is easily flexed and which does not react with the aluminum or the braking material. Also, the spline can take one of many shapes as long as it bottoms out and is retained in the V-shaped groove and seals the second chamber. No special tolerances are required in either the V-shaped groove or in the flexible spline because the spline is merely pushed into place until bottoming out against the V-shaped portion of the extrusion and prior to filling the second chamber with the thermal brake material. It should be understood that, while a V-shaped portion of the extrusion is discussed and is the preferred shape therefor, it is merely necessary that the support for the spline be inwardly tapered as it moves away from the chamber to insure that the spline will be secured therein.

It is readily apparent that the spline can be placed in the V-shaped member easily and inexpensively relative to the prior art rigid vinyl channel, the V-shaped member holding the spline in place therein over the break in the flat bottom portion thereof.

DESCRIPTION OF THE PREFERRED EMBODIMENT

Figure 1:
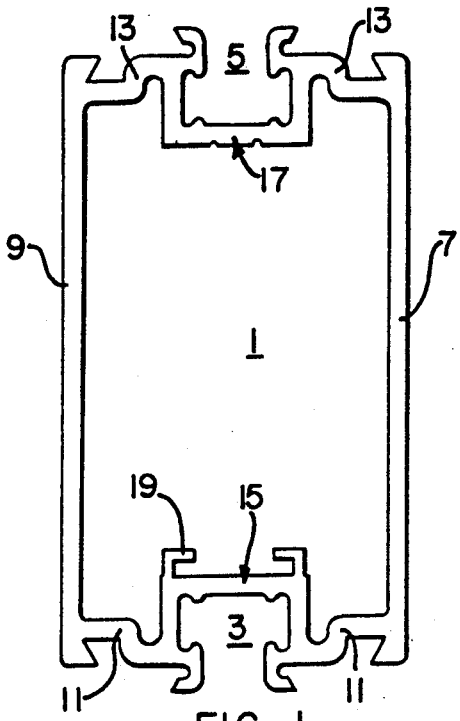
FIG. 1 Prior Art
FIG. 1 is a cross sectional view of an aluminum extrusion with two thermal brakes therein according to the prior art.

Referring first to FIG. 1 there is shown an aluminum extrusion 1 in accordance with the prior art with a pair of chambers 3, 5 for reception of thermal braking material therein according to the prior art. The extrusion includes a pair of side or wall members 7 and 9 with top and bottom sections 11 and 13 securing the chambers 3 and 5 to the side members.

The thermal brakes are fabricated by initially filling the chamber 5 with thermal braking material as in the prior art. When the thermal braking material in the chamber 5 sets, the bridge 15 of the chamber 3 and the bridge 17 of the chamber 5 are cut during a single cutting operation, forming a slit entirely through each of the bridge members 15 and 17 so that the extrusion is now in two section which do not touch except for the thermal braking material in the chamber which holds the two sections together. At this time, in order to fill the chamber 3 with thermal braking material, it is necessary to secure a rigid vinyl strip in the channel formed by fingers 19 along the entire length of the extrusion under the slit formed in the bridge member 15 to close that slit and permit thermal braking material to be poured into the chamber 3 without spilling out. Placement of the rigid vinyl slits into the chamber 3 to close the slit therein is relatively expensive and time consuming as noted hereinabove and provides dimensional tolerancing problems.

Referring now to FIGS. 2 to 6, there is shown a method of fabricating an aluminum extrusion having a pair of thermal brakes therein which avoids the expense of the prior art resulting from placing the rigid vinyl strip in the channel as described hereinabove and which provides improved dimensional tolerancing.

Figure 2:
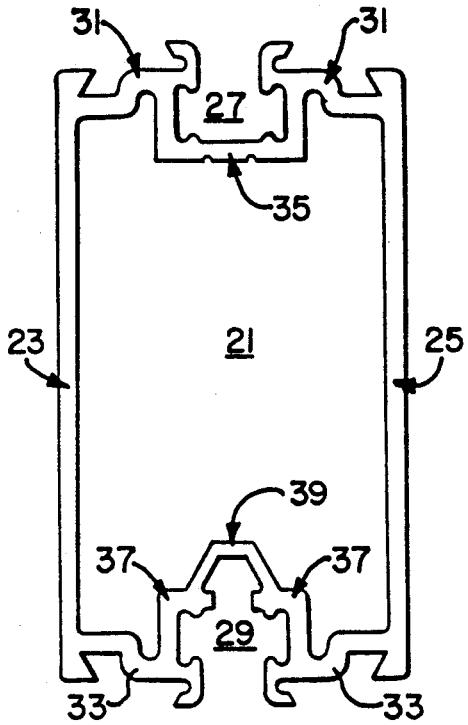
FIG. 2 is a cross sectional view of an aluminum extrusion in accordance with the present invention.

Referring now more specifically to FIG. 2, there is shown an aluminum extrusion 21 as extruded in accordance with the present invention. The extrusion includes side walls 23 and 25, an upper chamber 27 for receiving thermal braking material therein and a lower chamber 29 for receiving thermal braking material therein. The upper chamber 27 is secured to the side walls by a top section 31 and the lower chamber 29 is secured to the side wall by a bottom section 33. The upper chamber 27 includes a bridge member 35 whereas the lower chamber 29 has an as extruded break in the bridge member 37 with a V-shaped member 39 bridging the break in the bridge member 37, the "V" preferably being flattened between the side walls thereof as shown in the drawings.

Figure 3:
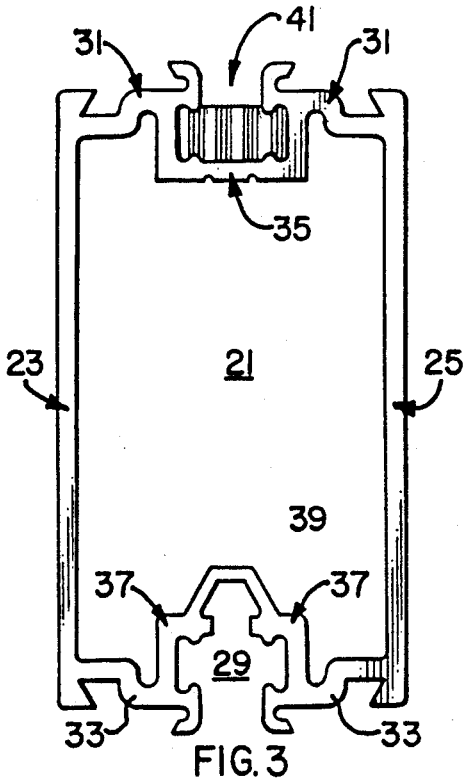
FIG. 3 is a cross sectional view of the extrusion of FIG. 2 after initial thermal brake filling.

Referring now to FIG. 3, it can be seen that initially the chamber 27 is filled with a thermal braking material 41 of standard and well known composition, preferably a polyurethane, which has very low heat conductivity relative to aluminum, this material being permitted to set.

Figure 4:
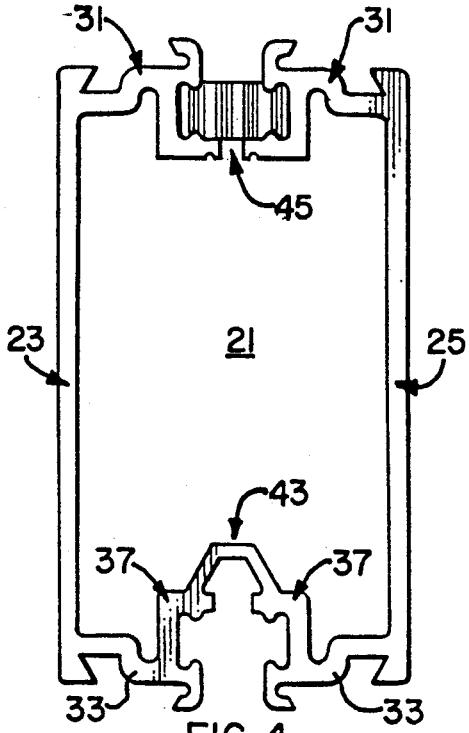
FIG. 4 is a cross sectional view of the extrusion of FIG. 2 after completion of processing to complete the first thermal brake.
Figure 5:
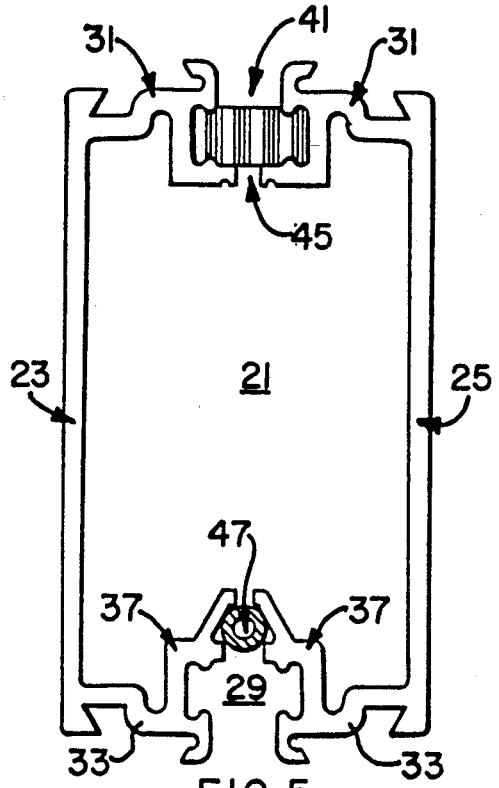
FIG. 5 is a cross sectional view of the extrusion of FIG. 2 after insertion of the flexible spline.
Figure 6:
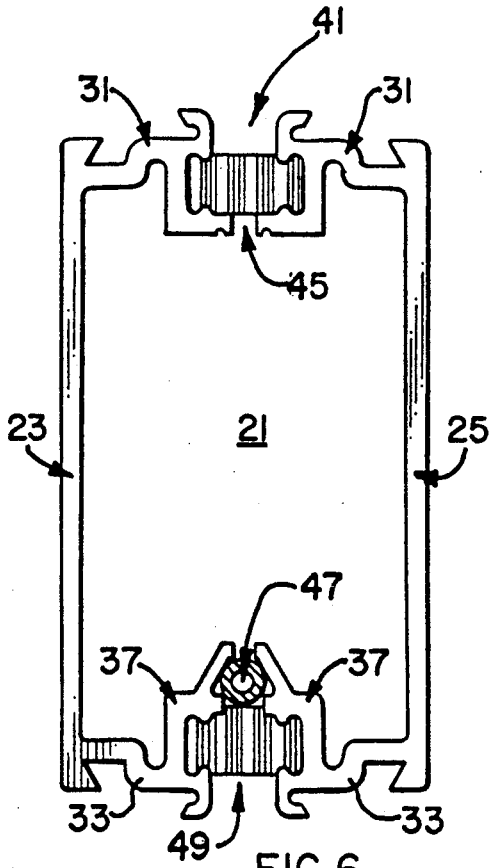
FIG. 6 is a cross sectional view of the extrusion of FIG. 2 after completion of the final thermal brake filling.

Referring now to FIG. 4, it can be seen that a part of the flat portion of the V-shaped member 39 has been severed at 43 as has the bridge member 33 at 45. This causes the two sections of the extrusion and specifically walls 7 and 9 thereof to be thermally isolated from each other. It is now necessary to fill the chamber 29 with the liquid thermal braking material. This is accomplished by placing a flexible spline 47 of vinyl or other appropriate material through the chamber 29 and into the V-shaped member 39 and over the slit 43 therein to prevent leakage of the liquid thermal braking material through the slit 43 as shown in FIG. 5. The spline is shown as being circular with an aperture through the center thereof. However, the spline can take almost any geometrical shape, such as, for example, triangular, it merely being necessary that the spline cover the break 43 in the V-shaped member 39. The lower chamber 29 is then filled with the thermal braking material 49 to provide the completed extrusion with double thermal brake therein.

It should be understood that the entire chamber 49 need not be filled with the thermal braking material. Optionally, only the V-shaped portion 39 can be filled with the spline and thermal braking material instead of the V-shaped portion and part or all of the chamber 29.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A method of making an aluminum extrusion having a pair of thermal brakes therein, comprising the steps of:

(a) providing an unitary aluminum extrusion having:

(i) a pair of side walls;

(ii) upper and lower wall members, each of said upper and lower wall members secured to each of said side walls; and (iii) a pair of chambers, each chamber forming a portion of a different one of said upper and lower wall members and spaced from said side walls, one of said chambers having a first continuous bridge member forming a wall of said one chamber and forming the only bridge connecting portions of one of said upper and lower wall member, the other of said chambers disposed in the other of said upper and lower wall member and having a second bridge member forming a portion of a wall thereof, said second bridge member having a pair of outwardly extending members tapered toward each other in a direction away from the other of said chambers and forming the only bridge interconnecting portions of said lower wall member;

(b) disposing thermal braking material in said one chamber and allowing said thermal braking material to set in said one chamber;

(c) then forming a continuous slit in said continuous bridge member and between said tapered outwardly extending members to cause a thermal separation of said side walls from each other;

(d) placing a flexible leak preventing member against said tapered outwardly extending members contacting only a minor portion of both of said outwardly extending members, having a geometrical shape different from the space within said outwardly extending members and disposed over said continuous slit therein; and (e) then filling said other chamber with a thermal braking liquid and allowing said thermal braking material to set in said other chamber.

2. The method of claim 1 wherein said thermal braking material is taken from the class of thermal insulators consisting of resinous materials, inorganic filler and inorganic fibers.

3. The method of claim 2 wherein said tapered outwardly extending members form a V-shaped member which is thin relative to said bridge members.

4. The method of claim 3 wherein said leak preventing member is a flexible spline shaped to seal said slit between said tapered members.

5. The method of claim 2 wherein said leak preventing member is a flexible spline shaped to seal said slit between said tapered members.

6. The method of claim 1 wherein said tapered outwardly extending members form a V-shaped member which is thin relative to said bridge members.

7. The method of claim 6 wherein said leak preventing member is a flexible spline shaped to seal said slit between said tapered members.

8. The method of claim 1 wherein said leak preventing member is a flexible spline shaped to seal said slit between said tapered members.

* * * * *